US007334796B2

(12) United States Patent
Wittwer

(10) Patent No.: US 7,334,796 B2
(45) Date of Patent: Feb. 26, 2008

(54) SPORTING EVENT PREDICTION AND SKILL GAME

(76) Inventor: Charles A. Wittwer, 10338 Oak Ranch La., Escondido, CA (US) 92191

( * ) Notice: Subject to any disclaimer, the term of this patent is extended or adjusted under 35 U.S.C. 154(b) by 0 days.

(21) Appl. No.: 11/065,262

(22) Filed: Feb. 25, 2005

(65) Prior Publication Data

US 2006/0192334 A1 Aug. 31, 2006

(51) Int. Cl.
*A63F 3/00* (2006.01)

(52) U.S. Cl. ..... 273/277; 273/244

(58) Field of Classification Search ..... 273/277, 273/244, 259

See application file for complete search history.

(56) References Cited

U.S. PATENT DOCUMENTS 5,782,470 A * 7/1998 Langan ..... 273/139

6,293,868 B1 * 9/2001 Bernard ..... 463/42

* cited by examiner

*Primary Examiner*—Vishu K. Mendiratta
(74) *Attorney, Agent, or Firm*—The Nath Law Group; Robert P. Cogan

(57) ABSTRACT

In a system and method for playing a game in conjunction with viewing an event, predictions are made regarding elements of the event, and physical activity simulating an element of the event is performed. The event may be a televised sporting event such as a football game. Predictions are preferably made before the event. Points are awarded for each correct prediction and for achieving a selected objective in physical activities, e.g., propelling a ball to a target. A referee's score sheet may be kept for recording actual results. Awards may be provided for each portion of the event, e.g., quarters, for the physical activities and for of the entire game. Equipment for the physical activity, prediction sheets, referee score sheets, a tote board, a rule book, markers for setting up the physical elements of the game and a container for the game system may further comprise the game system.

1 Claim, 14 Drawing Sheets

19-1

19-2 19-3 19-4

19

195

SPORTING EVENT PREDICTION AND SKILL GAME

FIELD OF THE INVENTION

The present subject matter relates to entertainment in conjunction with events, and more particularly to a game combining making predictions and performing feats of skill relating to a sporting or other event.

BACKGROUND OF THE INVENTION

Viewing of a sporting event, commonly a broadcast sporting event, is often the basis for a social occasion. Many people host parties at which guests gather to watch an event on television. A popular event for which parties are hosted is the Super Bowl, the championship game of the National Football League. Many people wish to provide entertainment at parties in addition the viewing of the game. Prior art games have been provided which may be played in conjunction with a sporting event in progress. However, they have generally been "one dimensional" in that they are directed to one aspect of the event, e.g., making a prediction. Also, many prior art games are directed to an activity participated in by an isolated individual. These games do not provide for social interaction, nor do they provide a more complete experience allowing participants to more fully identify with the event by simulated participation.

In the present description, entertainment will be discussed primarily in the context of an adjunct to viewing of football games. This is due to the popularity of football in the United States and due to the prevalence of football based games in the prior art. However, entertainment could be provided in conjunction with viewing of other sports such as baseball, basketball, NASCAR or Formula 1 racing, ice hockey, Australian Rules football, soccer, cricket or rugby. The considerations discussed herein also apply to other events which may also be resolved into a number of elements, wherein the elements each have a known fixed range of possible outcomes. The events may be events other than sporting events.

U.S. Pat. No. 6,287,199 discloses an interactive, predictive game control system for use in conjunction with a live TV event broadcast, e.g., a soccer match, received by one or more remote players. A central controller records the occurrence of one or more events relating to the live broadcast, e.g. first player to score, which are to be predicted by the remote players. Neither a social interaction nor a physical simulation of elements of the game is provided.

U.S. Pat. No. 4,019,737 allows a player to utilize his or her own play calling ability to select a play in advance during an actual football game and comparing the selection with the actual play which is called and executed by the quarterback. A correct selection enables a player to take actions on a game board in accordance with game rules. Meanwhile, U.S. Pat. No. 5,916,024 discloses a game that is played in conjunction with a broadcast show. Players use video game consoles to make a sports prediction, and may enhance winnings by further answering questions with respect to advertising content. The former game requires focusing of attention on a game board. The latter game requires an additional, instructional signal modulated onto a signal transmitted concurrently with the television program, or time-multiplexed with television signals. Neither game involves physical tasks required of the players to further enhance the experience of simulating participation in the event.

U.S. Pat. No. 6,394,895 discloses a video game that can be played in parallel with the progress of an actual sports event, e.g., a baseball game. A mouse is operated by a video game player to input a prediction about a type and a course of the next pitch. Also, a prediction apparatus also produces a data-based prediction. A determining means determines for the video game player's prediction and the data-based prediction whether the predictions are right or wrong by comparing them with the results. This game includes only the task of making predictions, and does not encourage social interaction.

SUMMARY OF THE INVENTION

Briefly stated, in accordance with embodiments of the present invention, there are provided a system and method for playing a game in which both predictions regarding an event are made and in which physical activity is also required. Communal participation by players is facilitated. The predictions are made by selecting a prediction option from a set of prediction options. The event could be a sporting event such as a football game. The event is preferably resolved into portions, generally in accordance with the rulebook of the event. The game further comprises physical participation related to elements of the event. Physical participation could include propelling a projectile, such as throwing or hitting a ball. It is also desirable to provide a game system which may be a tool in advertising without requiring advertising to be part of the game.

In order to produce sets of prediction options, a menu of event elements is generated. Each element has possible outcomes associated therewith. A set of possible outcomes is generated to provide a prediction option set. Players make a prediction regarding the elements of the event, e.g. in a football game, elements could include who will win the coin toss or whether the first play of the game will be a run or pass. A prediction is made by selecting one member of a set of prediction options. Points are awarded in conjunction with each prediction. A point award may be based on the correspondence of the prediction with an actual occurrence in the game. A point award could also be based on a player's prediction being closer to an actual outcome, e.g., a point tally, than other players. Additionally, skill contests may simulate elements of the game. Points are awarded for one or more physical activities. In the case of a ball game, a preferred activity is propelling a projectile to a target or target area. In the case of an academy award game the physical activity could comprise reciting a long list of acknowledgments in a very short time period. In the case of a football game, the preferred physical activities are throwing a football into a target aperture and kicking a football between two posts. The ball may be inflated plastic or soft foam suitable for indoor use. Awards may be provided for each portion of the game and for the person having the most points at the end of the entire game or the entire game plus the physical activities. One or more persons may act as referee to keep score. The use of one or more officials further simulates participation in a game.

The game apparatus includes indicia to be borne by the person or persons serving as officials and a symbol, e.g. a whistle. The game apparatus further includes equipment for the physical activity, prediction sheets (player score sheets), referee score sheets, a tote board on which scores of all players may be posted, markers for the sheets and tote board, a rule book, markers for assistance is setting up the physical elements of the game, game equipment for the physical elements of the game and a container for the game system.

This summary is neither exhaustive nor determinative of the scope of the present invention.

BRIEF DESCRIPTION OF THE DRAWINGS

The invention may be further understood by reference to the following description taken in connection with the following drawings.

DETAILED DESCRIPTION

Figure 1:
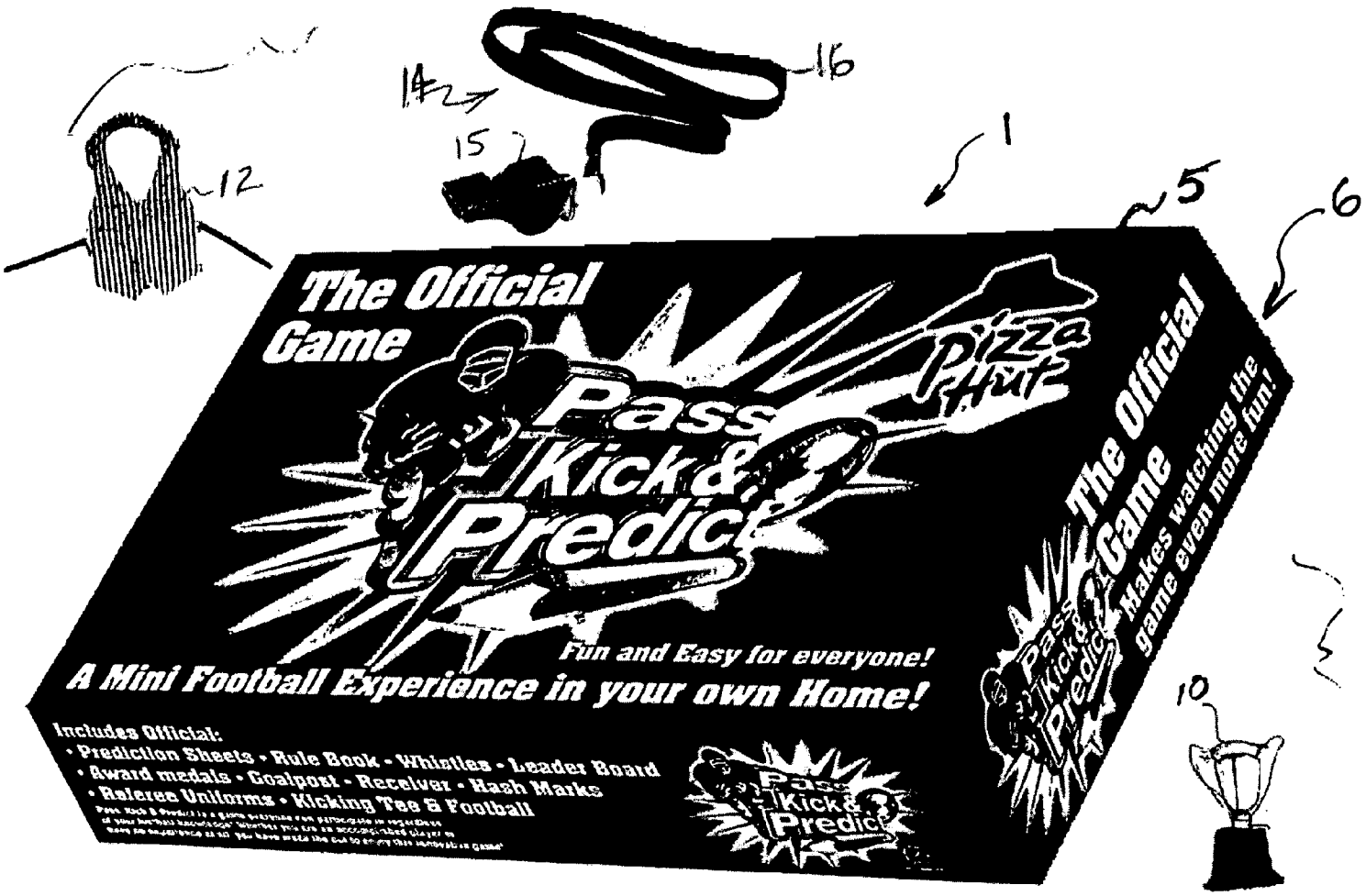
FIG. 1 is an illustration of a game system in its container.

The present game includes a game apparatus facilitating play in which a plurality of players may participate. The players will view an event together, e.g. a televised sports event. In playing the game, the players make predictions concerning the outcome of each of a number of elements that comprise the event. The predictions are generally made in advance of commencement of the event. The outcome could involve whether or not a particular element of the event will occur, the result of one side's performance of the element or scores associated with the element. During the event actual outcomes are recorded and compared to the predictions. Additionally, participants in the game perform a physical activity or activities which may each be a simulation of an element of the event. Embodiments of the invention are discussed in the context of being played in conjunction with the broadcast of a sporting event such as a football game. However, the game may be practiced in the context of events other than sporting events. Performance of the event is resolved into elements, further described below. The event may be further resolved into successive portions, whether by time or by milestones. Conduct of the game is preferably resolved into portions in the same manner as the event being viewed, but departures may be made. Additional embodiments comprise further aspects discussed below.

In the case of a football game, elements include running plays, passing plays, completions, incompletions, fumbles, interceptions, safeties, touchdowns, field goals, offensive and defensive penalties and challenges. Portions of the game are resolved temporally according to a rulebook. The game is resolved into quarters whose length is determined by a game clock. Elements within a baseball game include hits, strikeouts, walks, double plays, stolen bases, singles, doubles, triples and home runs, balks, passed balls, wild pitches and batters hit by pitches. Portions of the game are marked by milestones, namely half-innings which are each complete upon the occurrence of three outs. Other events can also be characterized by elements and portions. For example, elements of award shows, e.g. the Academy Awards presentations, comprise acceptance speeches, and outcomes regarding the acceptance speeches would include whether they refer to politics or go over the allotted time. Another element is clothing worn by accepters of awards and an outcome is whether it is conventional or not. The portions can be resolved into hours or groups of award categories. Some sports may have a plurality of resolvable portions, and one or more components may be used to define portions of a game. In the case of cricket, for example, for purposes of dividing the game, one could use outs or overs.

Each event may have different physical activities associated with it. In the illustration below, the activities selected for football are passing and kicking. Physical activities associated with baseball could include hitting and throwing. Physical activities included with an academy awards ceremony could comprise making a short recitation to acknowledge a large number of people in a short time period.

FIG. 1 is a non-limiting illustration of a game system 1 housed in a container 5. The container 5 houses parts for the game system 1 for a prediction portion of an event and parts for a portion of the game involving a physical skill related to the event. In addition to game elements for the players, further described below, the game system 1 includes a number of accessories. For example, an award 10 is provided. The event may further be simulated by designating further game participants as officials. A costume element 12 is be provided for the designated officials. In the case of football, the costume element comprises a striped vest. The costume element may be made of low-cost plastic or may be more elaborate. The official is provided with an accoutrement of office 14 which comprises a whistle 15 on a lanyard 16.

Figure 1A:
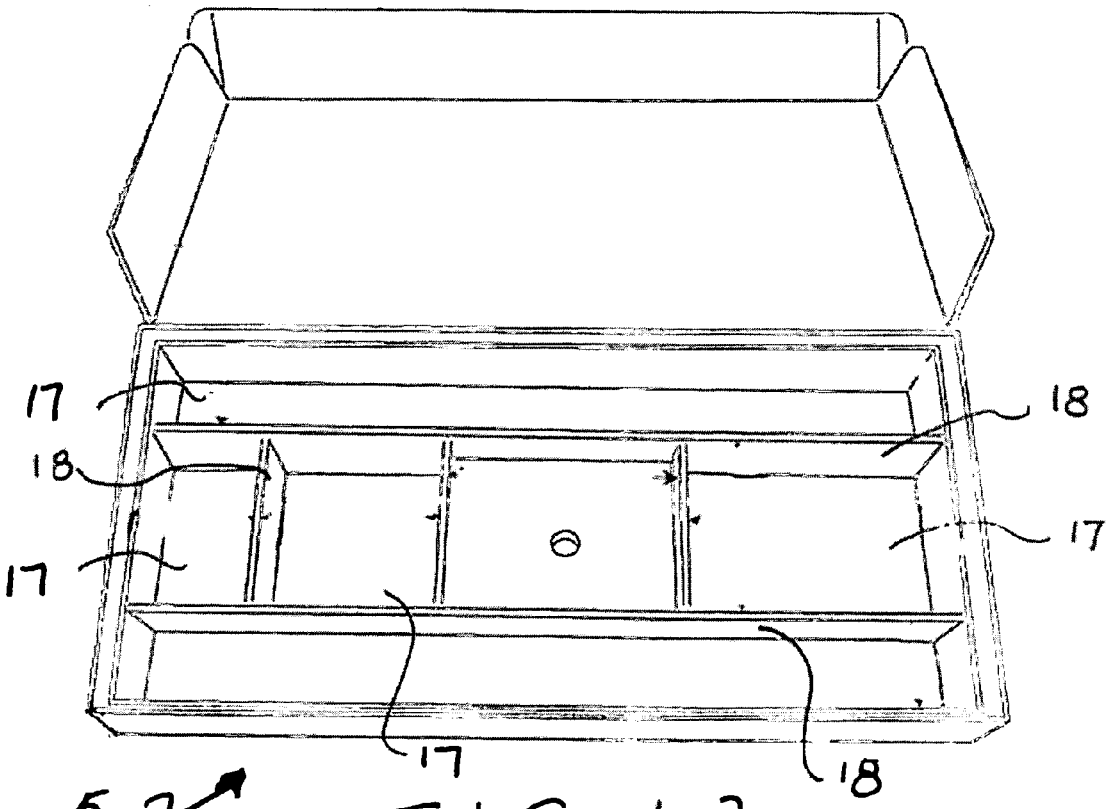
FIG. 1*a* illustrates an interior of the game system container.
Figure 1B:
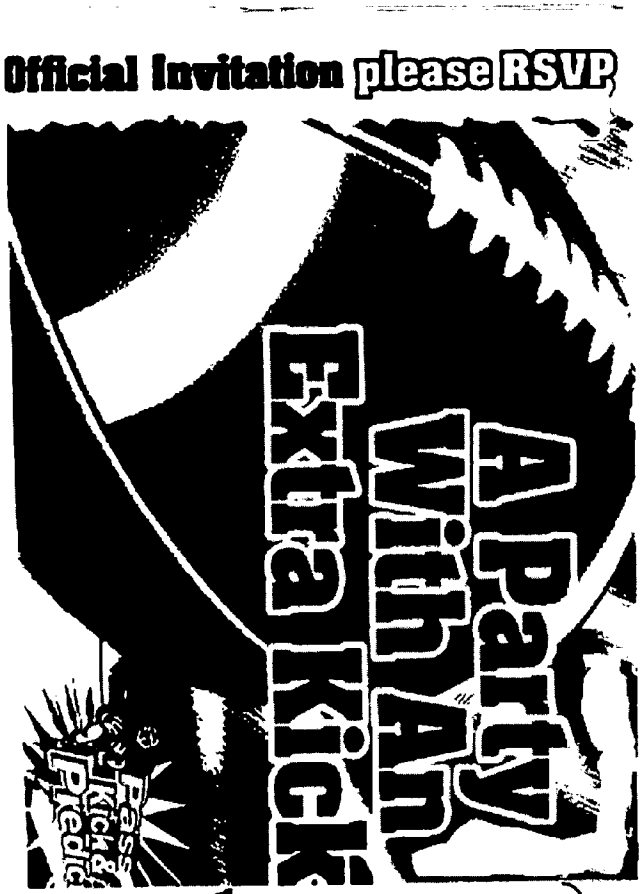
FIGS. 1*b* and 1*c* respectively illustrate a cover and in inner page of an invitation to participate in the game.
Figure 1C:
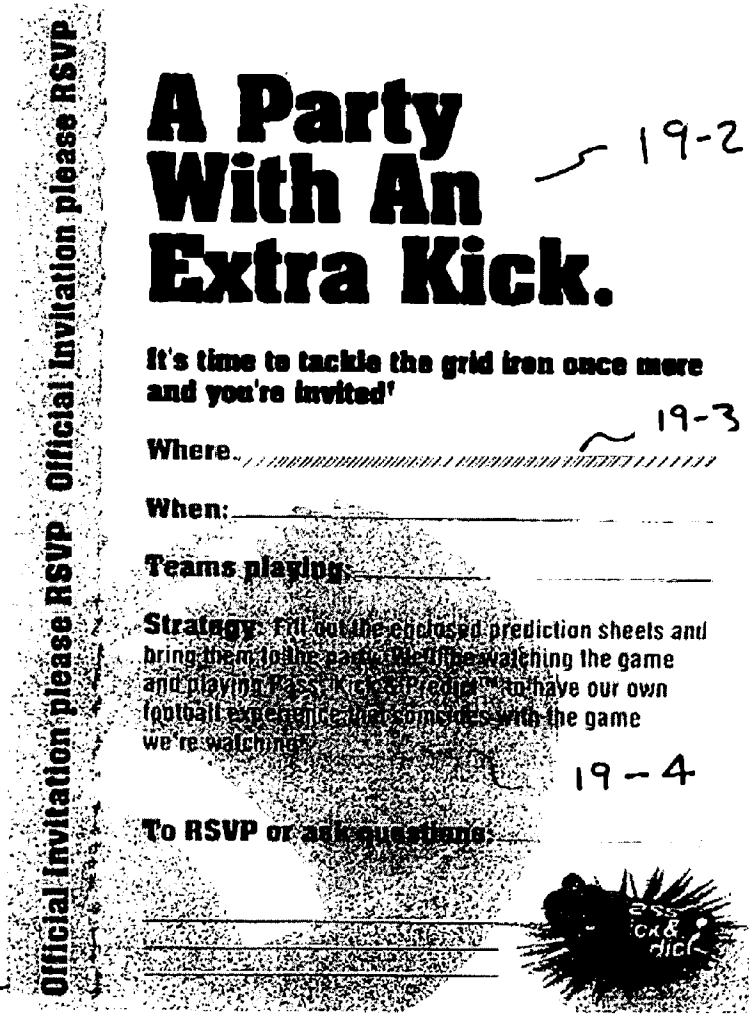

FIG. 1*a* illustrates an interior of the game system container 5. The container 5 comprises a plurality of compartments 17 separated by walls 18. The compartments 17 are dimensioned to house the above described accessories as well as the score cards and equipment for physical simulation of the game further described below. FIGS. 1*b* and 1*c* respectively illustrate a cover and in inner page of an invitation 19 to participate in the game at a social event. In one embodiment, the invitation 19 is configured as a greeting card. As seen in FIG. 1*b*, the cover of the invitation 19 contains a design 19-1 conveying information describing the nature of the invitation as well as decorative matter. The inner page of the invitation 19 includes a field 19-2 preprinted with data, a field 19-3 that can be filled in with such data as time, date and place, and a field 19-4 explaining the nature of the game. Game cards 20, further described with respect to FIG. 2 below, may be provided with the invitation 19. In this embodiment, players make predictions regarding the event prior to attending the social event.

To play the game, players make predictions with respect to elements of the event and also execute a physical activity related to a simulation of the event. A plurality of physical activities could also be performed. Points are awarded to players based on correspondence of predictions with outcomes associated with each prediction. Additionally, criteria are established associated with respect to physical activity on the basis of which points are awarded. Points are tallied, and winners are determined based on point totals.

Rules may be provided to define winners for portions of an event as well as one overall winner per event. Separate winners may also be recognized for the prediction and for the physical performance competitions within the game. Events may be resolved into portions, e.g. either temporally or by milestones. Generally, the game system 1 includes apparatus for recording results of elements within portions of the game in the same manner as the type of event being viewed.

The theory of the game system is explained first, and then the apparatus for implementing the game will be further described. It is contemplated that the event addressed in most embodiments will be a sporting event. The present illustration is discussed in the context of the football game. The present invention is not so limited. Principles of game design are discussed to enable those of ordinary skill in the art to make selections to provide a game system in contexts other than American football.

A rulebook defining the rules for an event can be utilized as a catalog of elements that can occur during the event. Alternatively, where an event does not have a formal rulebook, it may have a known format. A list of elements of the game may be constructed by a game designer simply based on knowledge of having watched games on television or having attended them in person. This could result in a less than complete list of elements for which to make predictions. Generally, an incomplete list will not adversely affect playability using the game system since completeness is not necessary. A game for a football event can be designed based on an individual's knowledge of football. However, a definitive version of the elements of the game of professional American football may be found in *Official Rules of the NFL* 2004, (National Football League; New York, N.Y.; 2003), or such editions as may subsequently come into effect. Many other football rulebooks exist, e.g., *Women's Flag Football Rule Book*, (Women's American Flag Football Federation; Wyndmoor, PA; 2003). However, the National Football League games are the most popular in terms of being a focus for Super Bowl parties and the like. The table of contents of *Official Rules of the NFL* 2004 is shown in Table I.

TABLE I

| | |
|---|---|
| Rule 1 | The Field |
| Rule 2 | The Ball |
| Rule 3 | Definitions |
| Rule 4 | Game Timing |
| Rule 5 | Players, Substitutes, Equipment |
| Rule 6 | Free Kick |
| Rule 7 | Scrimmage |
| Rule 8 | Forward Pass, Backward Pass, Fumble |
| Rule 9 | Scrimmage Kick |
| Rule 10 | Fair Catch |
| Rule 11 | Scoring |
| Rule 12 | Player Conduct |
| Rule 13 | Non-Player Conduct |
| Rule 14 | Penalty Enforcement |
| Rule 15 | Officials: Jurisdiction and Duties |
| Rule 16 | Sudden-Death Procedures |
| Rule 17 | Emergencies, Unfair Acts |
| Rule 18 | Guidelines for Captains |
| | Official Signals |
| | Index |

The rules establish that there are an offense and a defense. The team that gets initial possession of the ball is determined by a coin toss. The rules establish that there are running, passing and kicking plays. Scoring components comprise touchdown, field goal, conversion or safety. Teams accumulate points when they score. Scores at the end of different portions of the event may also be elements of the game. Elements contributing to a change of possession include fumbles, punts and interceptions. There are penalties that may be assessed and enforced. Challenges to certain calls by the officials may be made by the coaches of the respective teams. From elements of the game like those listed above, a menu of elements is selected. The following is a menu of elements that can be derived from elements listed in the NFL Rules.

MENU 1

Coin toss
Run play
Pass play
Other play
Penalty by offense: 5, 10 or 15 yard
Penalty by defense: 5, 10 or 15 yard
Touchdown
Field goal
Safety
Interception
Fumble lost
Fumble recovered
Team leading in score
Score of each team
Combined scores of the two teams
Time out taken
Play challenge by a team coach
Challenge upheld
Challenge denied Elements to be the subject of predictions are selected from the menu of elements. In order to provide players with a list of predictions from which they must choose, a prediction option set is produced. Members of a prediction option set may be formulated by associating a set of possible outcomes that can result when a selected element occurs with that element. Examples include a pass, which has the possible outcomes of complete or incomplete or intercepted. If desired, an intercepted pass could be regarded as incomplete.

Prediction option sets may be binary, i.e. one of two states may exist. For example, either Team A or Team B will be the first to score. (There is a possibility that neither team will score in the course of regulation time plus overtime, but this is statistically unlikely. Therefore, the value of possibilities of which team will score first is treated as being binary.) Another form of prediction option set with a binary selection for outcomes may also include an element associated with the possible outcomes as whether or not that element will occur. For example, the occurrence of an interception is associated with the possible outcomes that it will or will not occur. Alternatively, the prediction could call for a guess at a score. A prediction option set in this situation would comprise the set of zero and the natural numbers, one of which is selected by a player. This set could be used for a prediction with respect to the score at one or more points in the game. The score could be that accrued by one or both teams, for example at the end of a particular quarter. A player need not necessarily be right to gain points for the prediction, but only closer to the correct number than other players.

Alternatively, the rules could provide that a player has to guess a score exactly. Non-integers could also be used in a prediction set when accounting for "points," i.e., handicapping by providing for an addend with respect to the score of one of the teams. Non-integers could also be used for an element called "under-over." To make a prediction regarding this element, players guess whether the combined scores of the teams will be under or over a particular number that may be referred to as an under-over benchmark. By using a non-integer as the under-over benchmark, having a sum equal to the benchmark is avoided.

Use of a set of prediction options is described in the exemplary context of the component known as the coin toss, the first item on Menu 1 above. One of the two teams is granted initial possession of the ball based on whether it wins the coin toss. Officially, one team is the home team, and one team is the away team. However, in the Super Bowl, teams generally play in a city that is home to neither, and participants using the present game system will not intuitively regard either team as the home team. For purposes of the present description, the teams are therefore referred to as Team A and Team B. An official takes a coin having one side designated "heads" and the other side designated "tails." One team captain must "call" the toss by stating "heads" or "tails." The official tosses the coin, and one side is up when the coin lands. If the captain's call corresponds with the side that is up, the captain's team has won the coin toss. If not, the other team has won the coin toss.

In order to make the coin toss component the subject of a prediction, a statement of a possible outcome is made. Possible outcomes may be stated in terms of data, i.e., heads or tails. Alternatively, possible outcomes may be stated in terms of conclusions necessarily following from the data, i.e. Team A wins the coin toss or Team B wins the coin toss. Once a component is made the subject of a prediction, a prediction option may then be created. One prediction option set has the members, "Team A wins the coin toss" and "Team B wins the coin toss." This same prediction option set may be provided by asking, "Which team will win the coin toss?" Another prediction option that that may be provided is, "heads and tails." Sets of outcomes that may be associated with the element of the coin toss include "heads or tails" and "Team A wins coin toss or Team B wins coin toss."

The game system 1 includes means for enabling a player to select a member of a prediction option set. The selecting of a member of a prediction option set may also be described as making a prediction. The game system, as further described below with respect to FIG. 2, for example, includes a field for entry of information indicative of predictions. A player makes a selection from a set of prediction options. Each prediction option corresponds to one of the possible outcomes for that prediction. By making the selection, a player is recording a prediction. Entry of the selection comprises making a recording of the selection, as by marking on a page. In this manner, a prediction is recorded.

The game system 1 includes means for presenting sets of prediction options and provides for recording of predictions by players prior to an event. The predictions are preferably recorded on a game card 20 illustrated in FIG. 2. The game card 20 has a plurality of fields 21. The fields 21 include information bearing areas and information entry areas for data both necessary and unnecessary to the play of the game. These fields include prediction option sets, places for recording predictions, indications of points available for correct predictions, points earned by a player and areas for decoration or placement of advertising messages. In the present illustration, separate game cards 20-1 through 20-4 are provided. In one alternative embodiment, the game cards 20-1 through 20-4 could each be printed in one quadrant of a single sheet. The sheet may be folded into a booklet containing the game cards 20-1 through 20-4.

A trademark field 22 is in a corner of the game card 20 which contains the name of the game. Adjacent the trademark field 22 at a top portion of the game card 20 is a portion field 24, which identifies the portion of the event for which it is used. As described above, in the example of a football game, the portions of the event will be quarters. In the present embodiment, four game cards 20-1 through 204 are provided for each player for use for the first through fourth quarters respectively. Therefore, in the present description, a game card 20 designation followed by a suffix denotes a game card for the quarter indicated by the suffix. Game card 20 without a suffix refers to any game card. The game card 20 depicted in FIG. 2 will have $1^{st}$ quarter filled in in the portion field 24 and is therefore referred to as game card 20-1. At a first side of the game card 21, an advertising field 26 is provided. A manufacturer of the game system 1 may market the game system 1 in a food or beverage outlet in conjunction with a product promotion. The advertising field 26 contains promotional information from one or more advertisers. The same or different advertisers may be promoted on game cards 20 for different quarters, or no advertisers at all may be promoted on the game card. At the bottom of the game card 20 a rules field 28 is provided in which information explaining how points are awarded may be stated.

The game card 20 also comprises a data area 36, which may be viewed as comprising columns 38. Various numbers of columns 38 may be provided. In the present example, columns 38*a*, 38*b*, 38*c* and 38*d* are provided respectively for listing a component of the game for which a prediction is being made, recording a prediction, listing points available for a correct prediction and recording points earned by a player. The function of providing the prediction set is shared by column 38*b* with column 38*a*. Column 38*a* lists the component. Column 38*b* lists all the options for a prediction that is binary or has a small number of possibilities. Alternatively, column 38*b* includes a blank place for a player to fill in a member of a large set, e.g., the set of non-negative integers. Of course, if desired, a producer could print a large range of numbers in a field on a game card so that the player could simply circle one number.

The data area 36 also includes rows. A number of rows may each be associated with one prediction. Another row may include fields to identify a player and provide legends for the columns 38. A further row may be included to comprise a bottom of column 38*d* in which a player's total score accumulated on the game card 20 is totaled. In the present embodiment, a first row 41 comprises a player name field 42, a point field 43 which acts as a header for column 38*c* and a score field 44, which acts as a header for column 38*d*. First through sixth prediction rows 51-56 are provided, each containing one entry for each of columns 38*a* through 38*c*. A scoring row 60 below the rows 51-56 contains a field 61 identifying that this row lists total score for the first quarter. Row 60 also includes a field 62 in which score is recorded. The score to be recorded in the field 62 is the sum of column 38*d* in each of rows 51-56.

Figure 2:
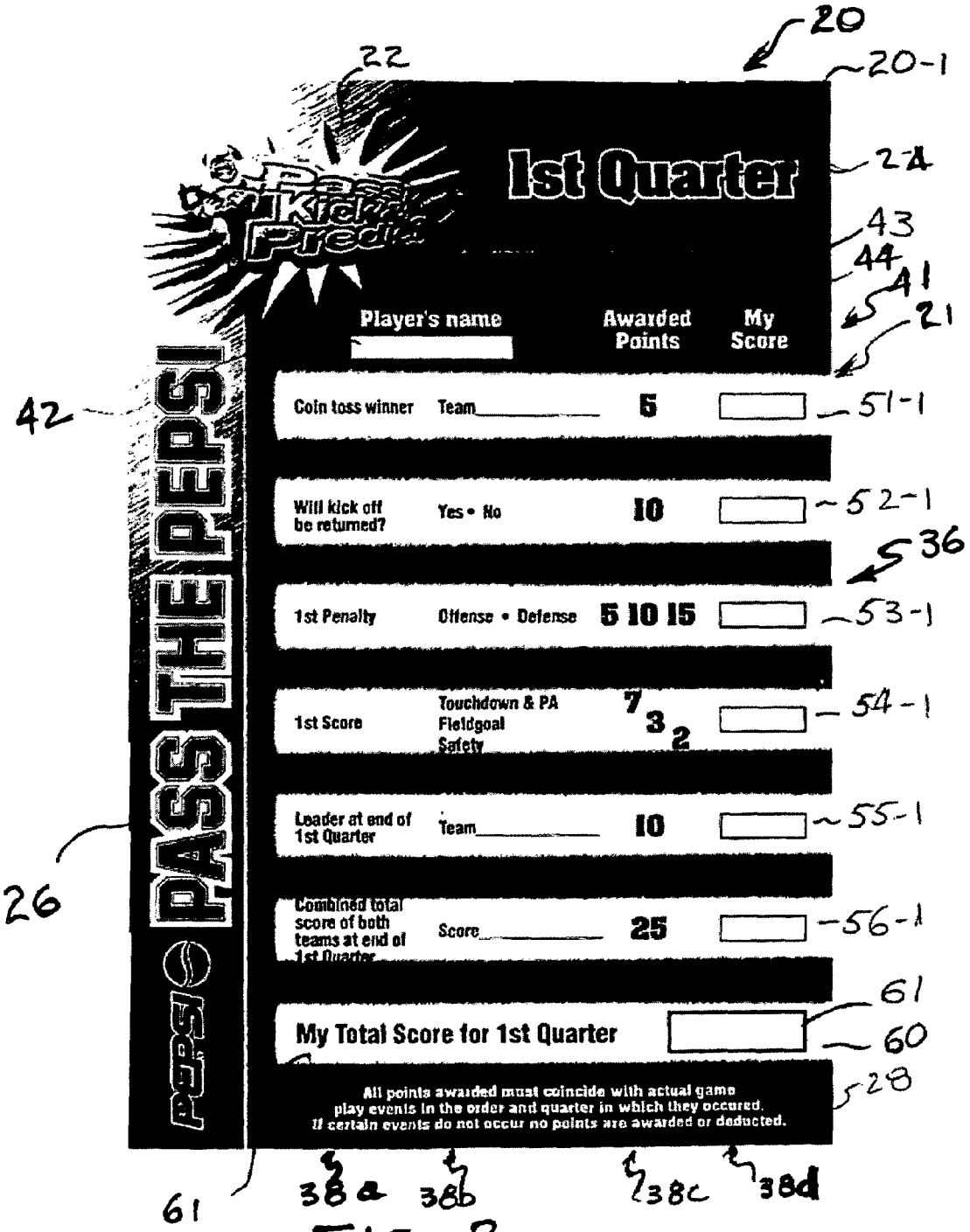
FIGS. 2-5 are illustrations of player prediction sheets for first, second, third and fourth quarters of a football game respectively.

In the illustration of FIG. 2, the following components of the football game are associated with the following rows of portion game card 20-1 and points available for a correct prediction:

| | | |
|---|---|---|
| 51-1 | Coin toss | 5 |
| 52-1 | Kick-off return | 10 |
| 53-1 | Team to draw first penalty | number of yards in penalty |
| 54-1 | First score | number of points scored |
| 55-1 | Leader at end of first quarter | 10 |
| 56-1 | Combined score at end of first quarter | 25 |

Figure 3:
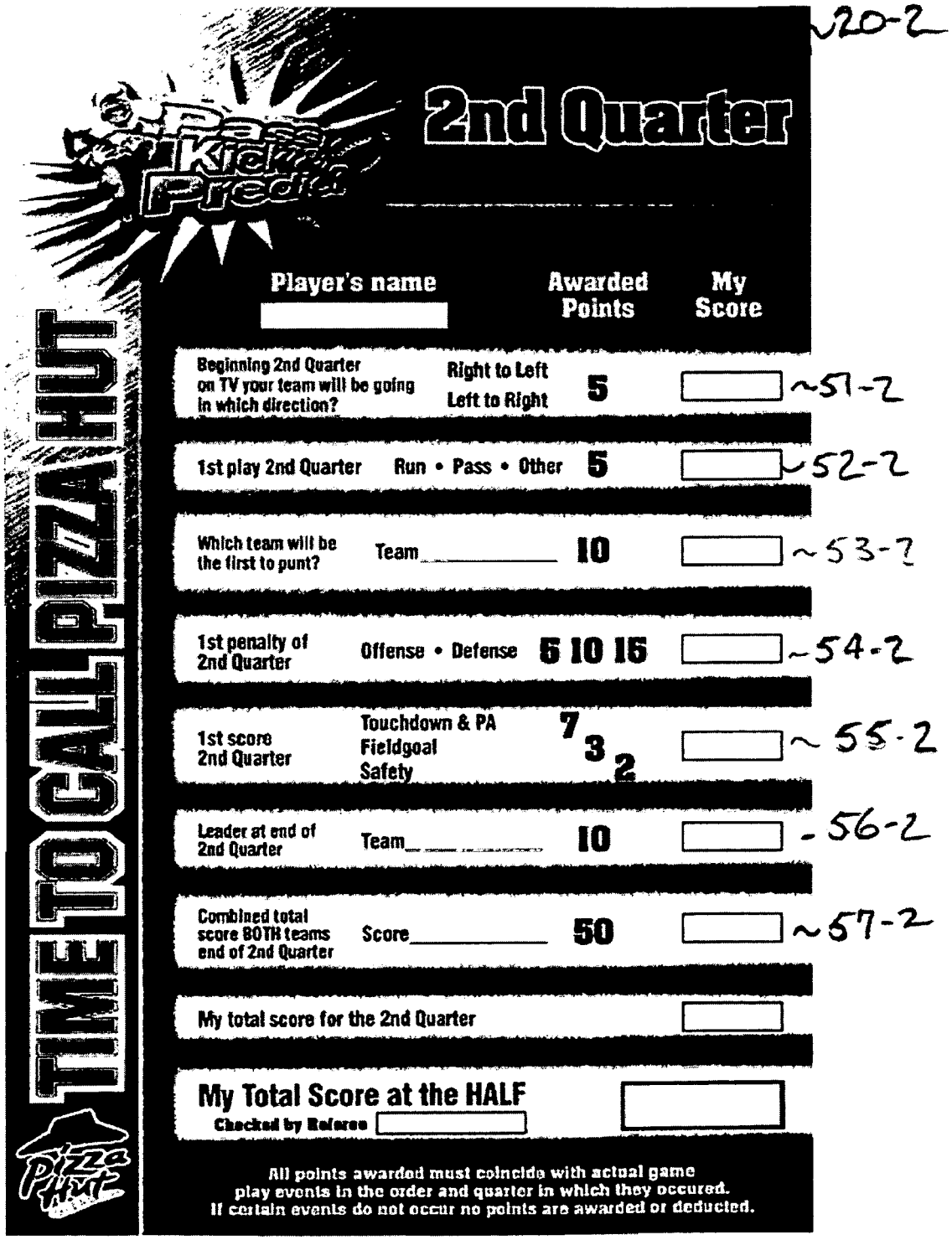

In the illustration of FIG. 3 the following components of the football game are associated with the following rows of portion game card 20-2 and point available for a correct prediction:

| | | |
|---|---|---|
| 51-2 | Direction of one team on television coverage | 5 |
| 52-2 | Kick-off return - yes or no | 5 |
| 53-2 | Team to draw first penalty | number of yards in penalty |
| 54-2 | First score | number of points scored |
| 55-2 | Leader at end of second quarter | 10 |
| 56-2 | Combined score at end of first quarter | 50 |

Figure 4:
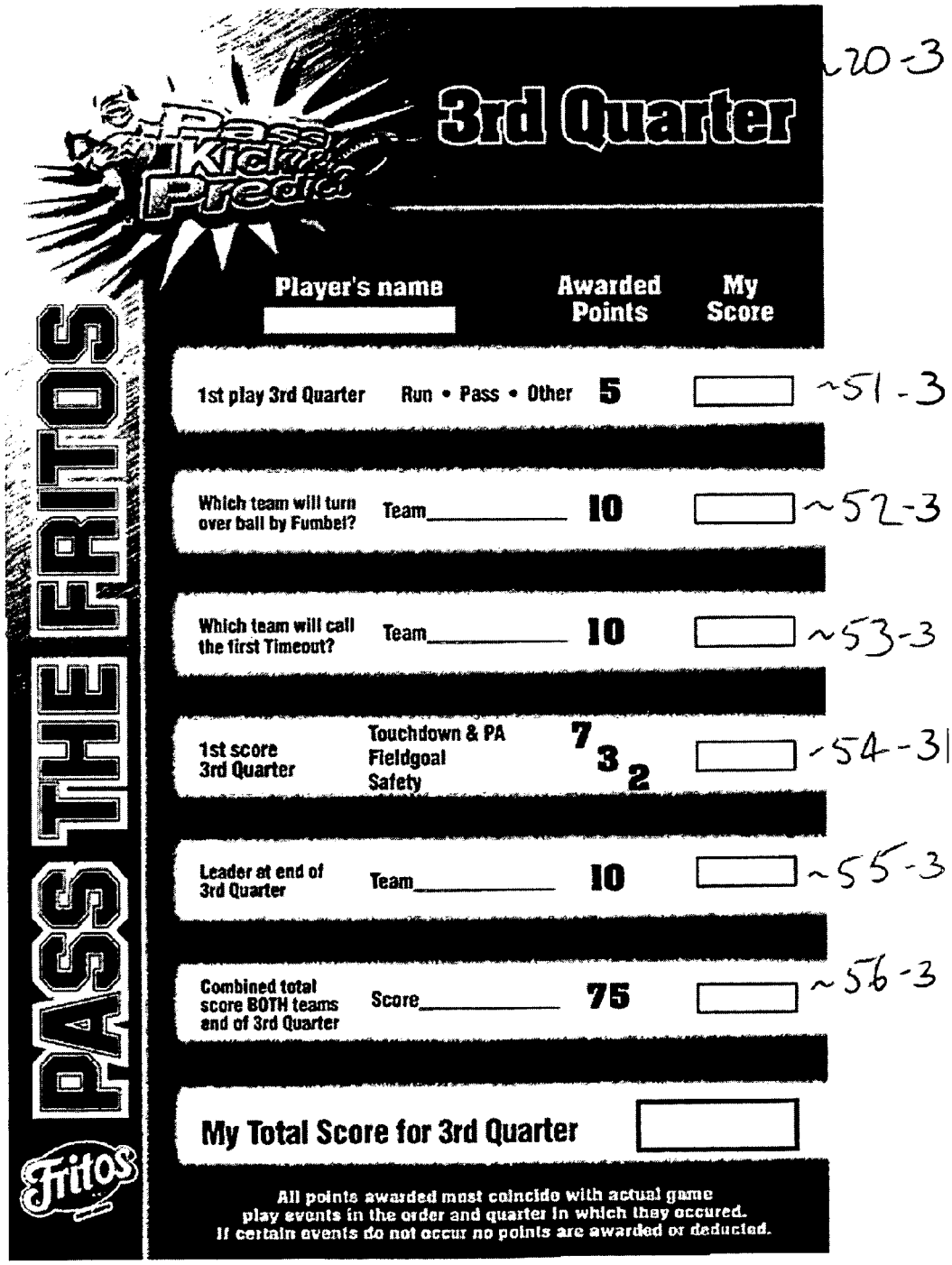

The following components of the football game in the illustration of FIG. 4 are associated with the following rows of portion game card 20-3 and point available for a correct prediction:

| | | |
|---|---|---|
| 51-3 | First play - run, pass or other | 5 |
| 52-3 | Turnover by fumble - Team A or Team B | 10 |
| 53-3 | First team to call time out | 10 |
| 54-3 | First score | number of points scored |
| 55-3 | Leader at end of third quarter | 10 |
| 56-3 | Combined score at end of third quarter | 75 |

Figure 5:
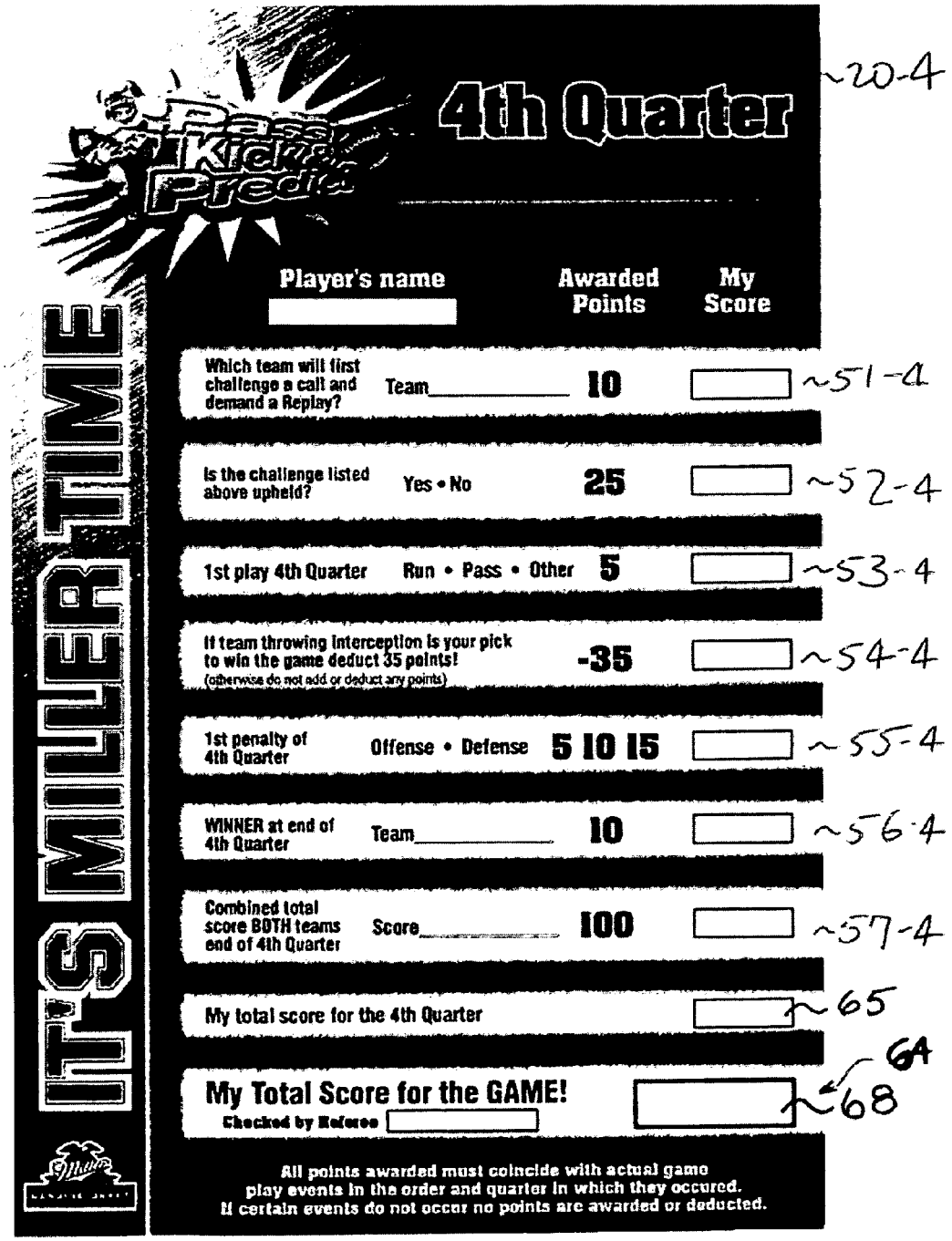

The following components of the football game in the illustration of FIG. 5 are associated with the following rows of portion game card 20-4 and point available for a correct prediction:

| | | |
|---|---|---|
| 51-4 | Exercise a challenge - Team A or Team B | 10 |
| 52-4 | Challenge upheld | 25 |
| 53-4 | First play - run, pass or other | 5 |
| 54-4 | Team selected in row 455 is intercepted - | 35 |
| 55-4 | First team to incur penalty | number of yards in penalty |
| 56-4 | Leader at end game - Team A or Team B | 10 |
| 57-4 | Combined score at end of fourth quarter | 100 |

Note that the game portion card 20-4 includes an additional row 57-4 since the game portion card 20-4 embodies seven prediction rows instead of six. The game portion cards 20-1, 20-2, 20-3 and 20-4 need not have the same number of prediction rows. The game card 204 also includes a total scoring row 64 with a field 65 identifying total score and a field 68 in which a sum of the scores in the fields 62-1, 62-2, 62-3 and 62-4 is recorded.

Figure 6:
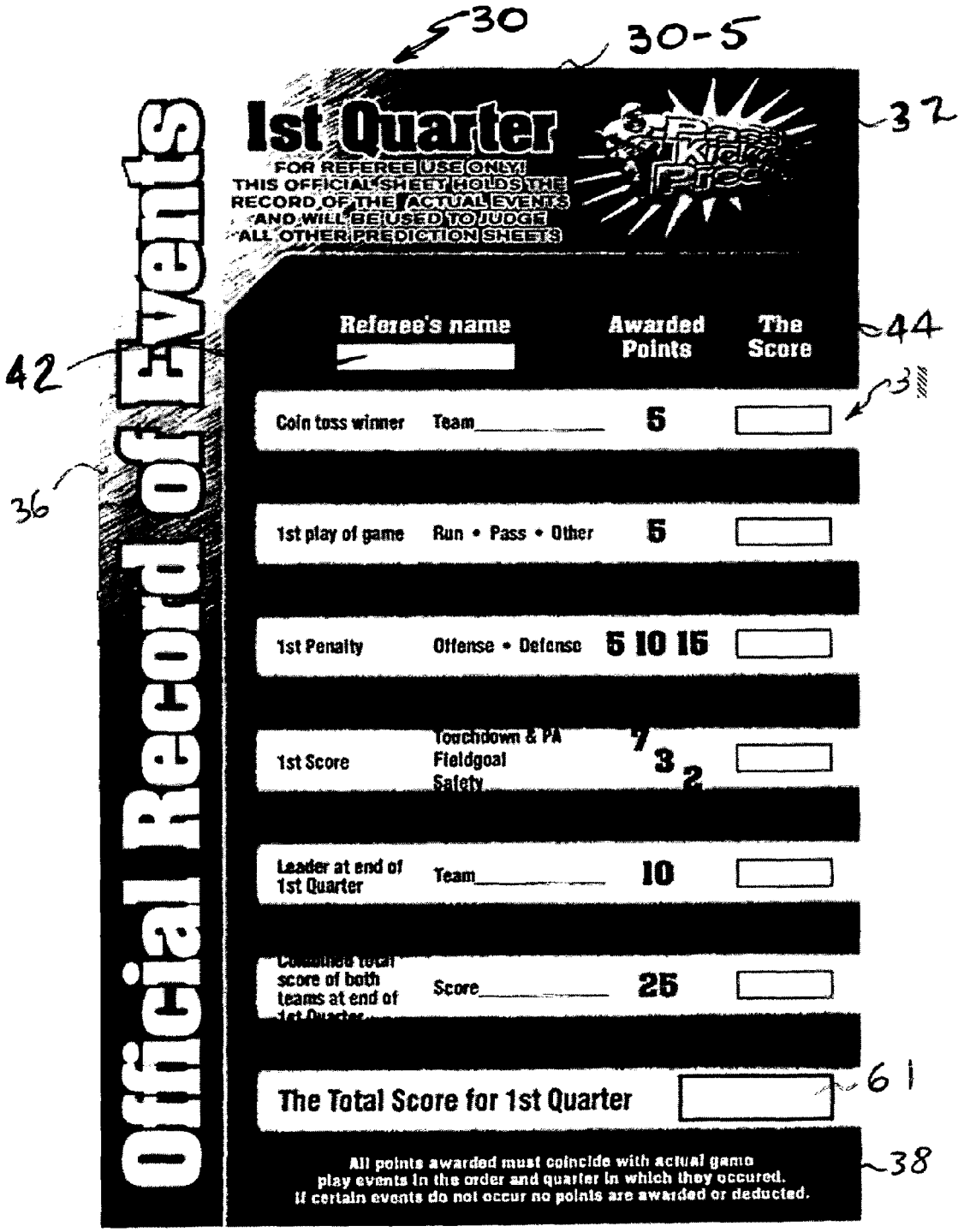
FIG. 6 is an illustration of a referee's score card.

The players of the game may track their own performance. However, in accordance with a preferred embodiment of the invention, one or more persons may be designated as a referee to keep an official game record of the actual events in the game. The referee or referees keep a separate score card, and the game cards 20 are graded by comparison to the official score card. FIG. 6 is an illustration of a referee's score card 30. In particular, FIG. 6 illustrates a score portion card 30-5 on which data is recorded.

Figure 7:
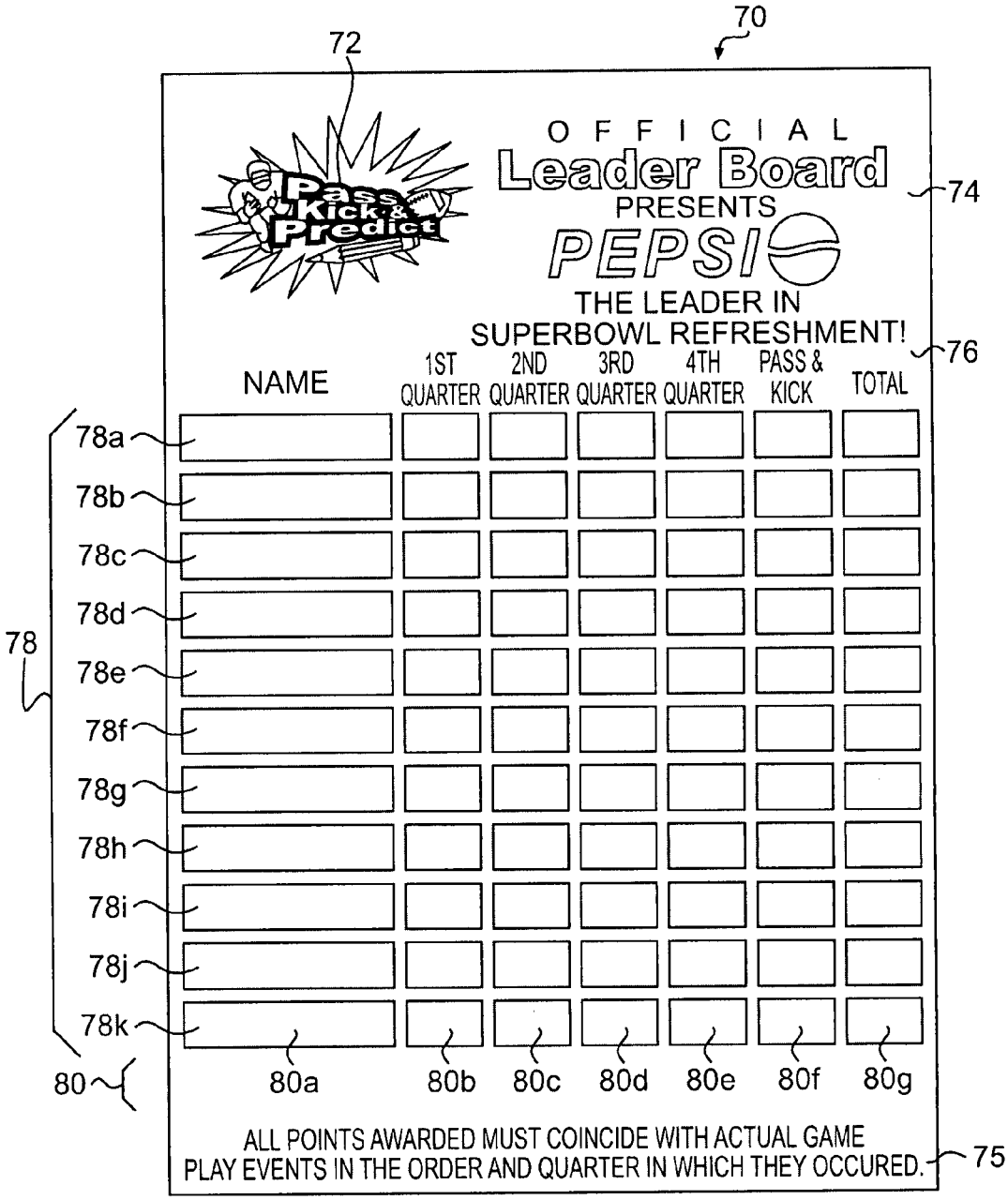
FIG. 7 is an illustration of a tote board.

FIG. 6 in conjunction with FIGS. 3-5 are illustrative of an entire score card 30 in that the score card portions 31, 32, 36 and 38 correspond to the game portion card 21, 22, 26 and 28 respectively, with differences as specified herein. Fields 44, 61 and 68 may be entitled "The Score" instead of "My Score" to indicate that the score on the score card 30 is official. Field 42 will state "Referee's name" in place of player's name. Field 26 may carry advertising indicia as in the game card 20 or may carry the legend "Official Record of Events," or other title indicative of the official nature of the score card 30. FIG. 7 illustrates a tote board 70 for recording scores for all players and for displaying all scores to the players. The tote board 70 may have any number of titles. In the present embodiment, a title field 74 bears the legend, "Leader Board." A trademark field 72 includes a game logo. An information field 75 may be located at the bottom of the tote board 70 to convey information about rules or other aspects of the game. In an upper portion of the tote board 70, a headings row 76 is provided above a plurality of player rows 78. In the present embodiment, there are eleven rows 78, denoted 78*a* through 78*k*. A heading is provided for each of a plurality of columns 80. In the present embodiment, columns 80*a* through 80*g* are provided. In column 80*a*, player names are listed. In columns 80*b* through 80*e*, player scores for each of the first through fourth quarters respectively are listed. Column 80*f* provides a field for recording scores based on physical performance aspects of the game, and column 80*g* comprises a field for listing a total score for each player.

In addition to the prediction portion of the game, playing the game also comprises performing a physical activity simulating an element of the event or an activity associated with the event. Physical simulation apparatus is provided in connection with the activity to be performed. A majority of events simulated by the game system of the present invention will be ball games of some sort.

Simulation of a physical component of a ball game should comprise propelling a projectile at a target. Particular embodiments are discussed with respect to FIGS. 9 and 10 below. The projectiles can be made suitable for indoor use by proper selection of materials. A target is provided to create a test of skill. The projectile must be propelled to the target to earn points. Projectiles may be made of thin inflatable plastic or of soft rubber foam, for example. Implement used to propel the projectiles may also be adapted for indoor use. Implements for baseball or hockey would include bats or sticks. In the case of football or basketball simulation, balls are propelled by players without the use of implements. The nature of the target varies with the game. A basketball target will comprise a hoop on a backboard. More than one activity of the event may be simulated.

Figure 8:
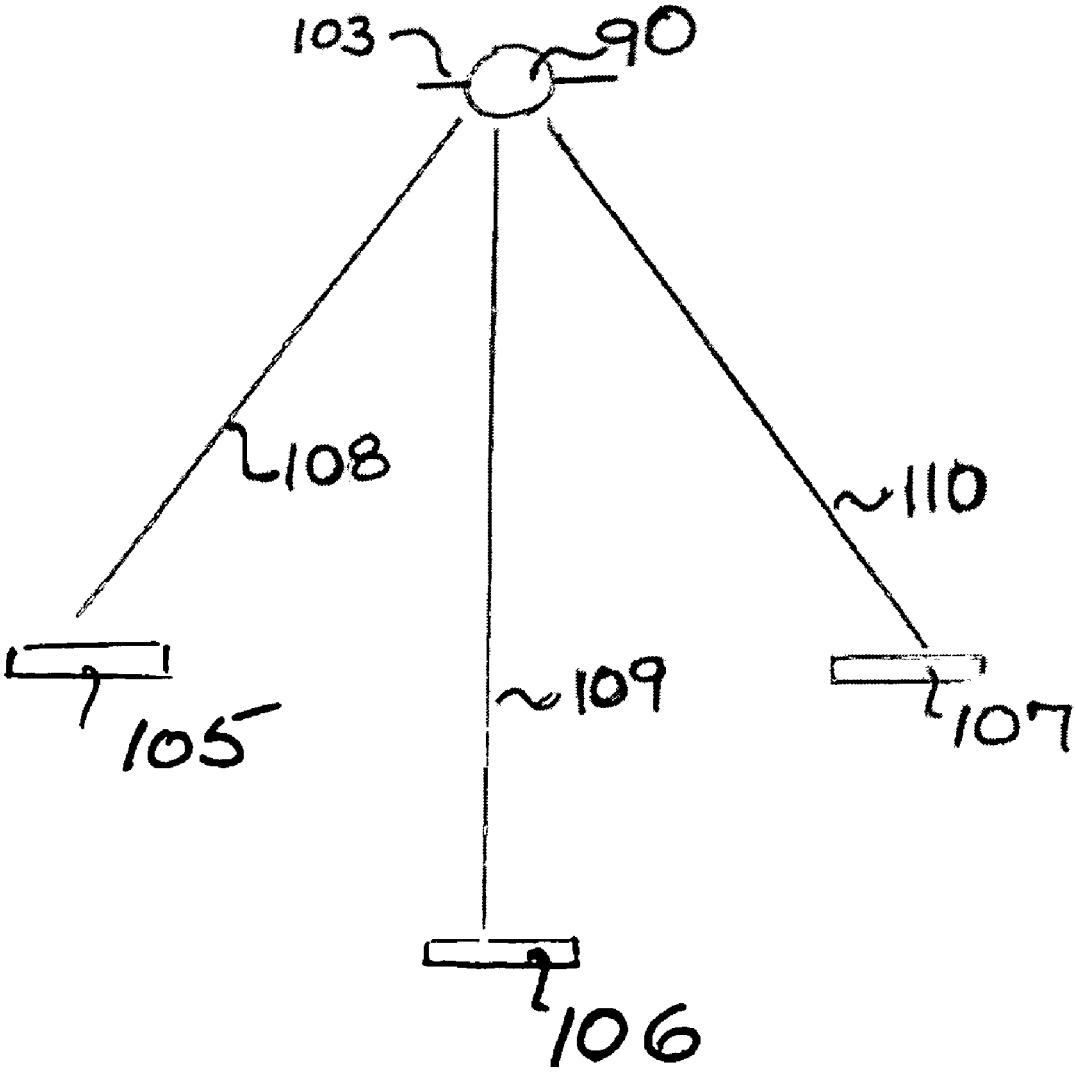
FIG. 8 is a diagram illustrating placement of apparatus for execution of physical elements of the game.

FIG. 8 is a diagram illustrating physical placement of apparatus for physical activity components of the game and placement of players with respect thereto. In the present embodiment, football is being simulated. Two physical events are selected for simulation in the game, forward passing and kicking. A target 90, illustrated by a symbol in FIG. 8, is located at a target location 103. The target 100 may take different forms, as further illustrated below. The target 90 will take one form for kicking and another form for forward passing, as further described with respect to FIGS. 9 and 10 below. A player performs the physical activity from one or more positions displaced from the target 100. Player positions 105, 106 and 107 are selected respectively defining paths 108, 109 and 110 to the target 90. The player positions respectively correspond to "wide left," center and "wide right." The rules may specify particular dimensions of each path 108, 109 and 110, or may use qualitative measurements such as "paces." The rules may also specify different lengths of the paths 108, 109 and 110 for adults or for children. Other forms of discrimination could also be established.

Figure 9:
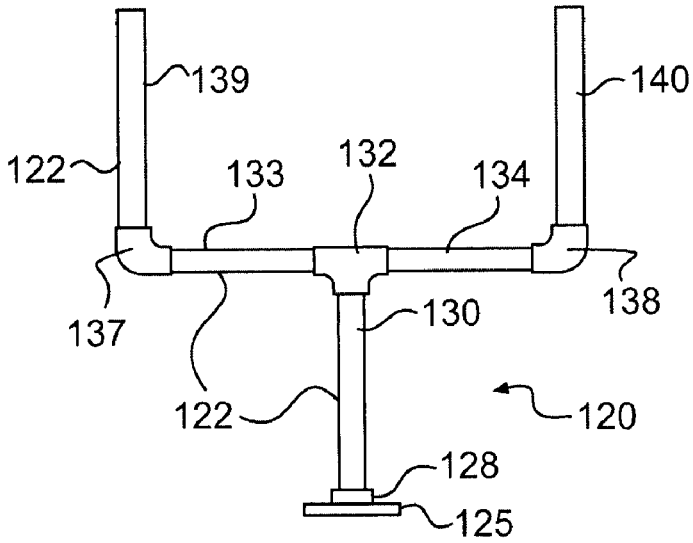
FIGS. 9 and 10 respectively illustrate first and second embodiments of goal post apparatus.

Different forms of targets may be provided. For the kicking contest, a simulated goal post 120, illustrated in FIG. 9 is provided. It is desirable that the goal post be of a type that can be included in a container 5 (FIG. 1) of a size that is reasonable in comparison to retail shelves, for example. The goal post 120 comprises a plurality of pipe sections 122. A suitable pipe material is PVC, which is white and light. A total height for the goal post 120 may be three feet. The goal post 120 comprises a base 126, which may be square, with an annular fitting 128 projecting upwardly therefrom to receive a central upright member 130. A T-coupling 132 receives first and second horizontal members 133 and 134 at first, inner ends thereof. Second, outer ends of the first and second horizontal member 133 and 134 receive elbow couplers 137 and 138, respectively. Left and right goal post uprights 139 and 140 are received in the elbows 137 and 138, respectively. This form of goal post 120 is easily assembled and also easily disassembled for storage in the container 5. In another version, the goal post 120 may be unitary and made by vacuum molding.

Figure 9A:
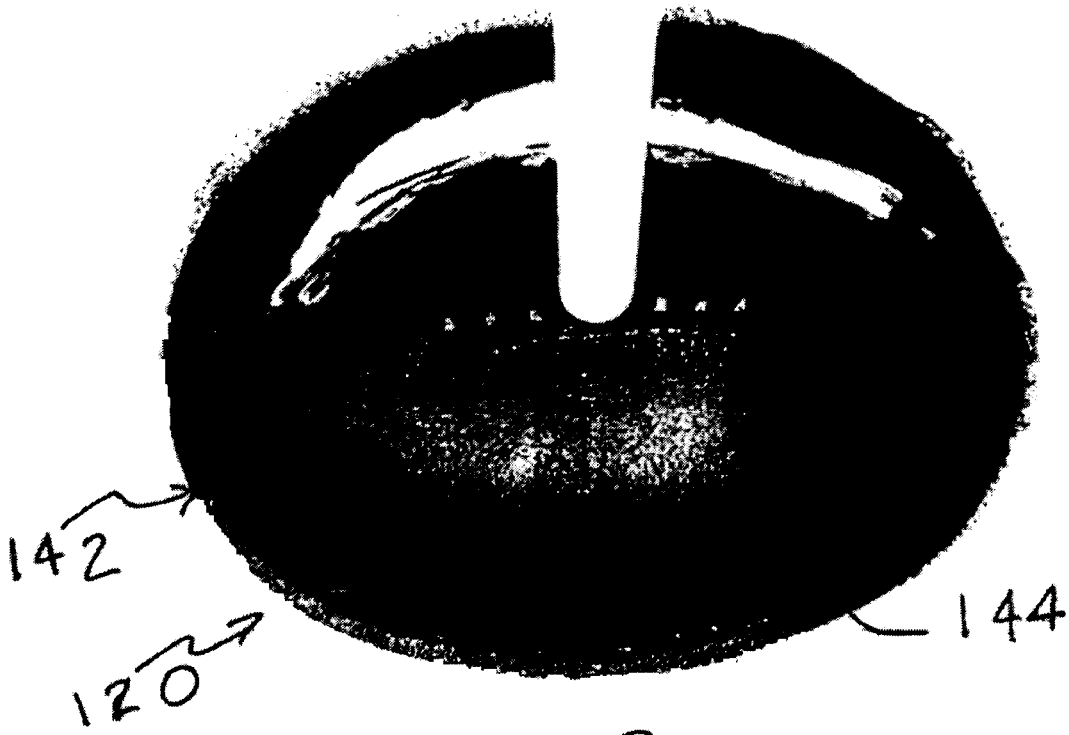
FIG. 9A illustrates an alternate form of the base of the goalpost.

FIG. 9A illustrates an alternate form of the base 126 of the goalpost 120. The base 126 has an annular border 142 in or on which indicia and ornamentation may be molded or printed. A center portion 144 is raised and in the shape of an object associated with the game. In the present illustration, the center portion is in the shape of the upper half of a football.

Figure 10:
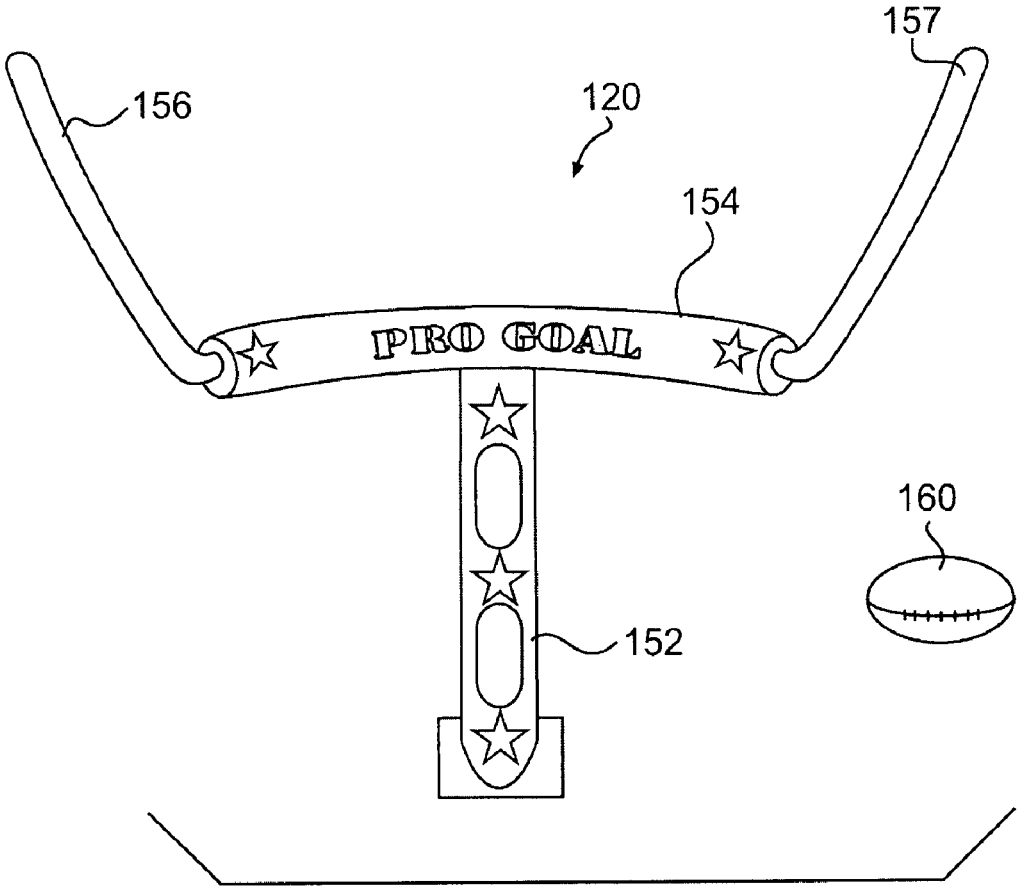

Alternatively, as seen in FIG. 10, an inflatable form 150 may comprise the goal post 120. The inflatable form 150 comprises a single air chamber supported to a base 152. A central upright supports a horizontal crossbar 154 having left and right goal post uprights 157 and 156 extending upwardly therefrom. With common thin inflatable materials and inflation levels not likely to burst the form 150, it is likely that the left and right goal posts will droop rather than maintaining rigorously vertical alignment. The form 150 still serves the purpose of providing a kicking target. In use, a player is positioned at each of player positions 105, 106 and 107 of FIG. 8 and attempts to kick a ball 160 through the left and right goal posts 139 and 140 of FIG. 9. The ball 160 may inflatable. The inflatable ball 160 may be used with either form of goalpost 120.

Figure 11:
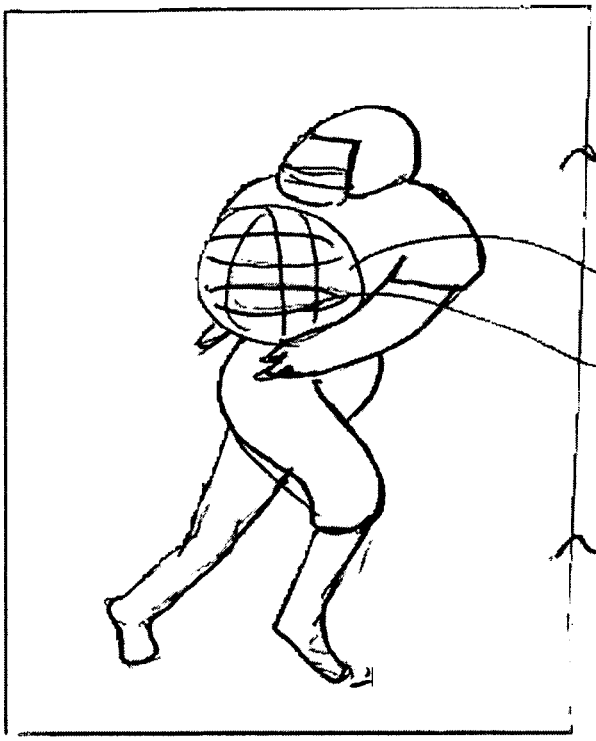
FIGS. 11 and 12 are a front and side elevation of a first embodiment of a pass receiving apparatus.
Figure 12:
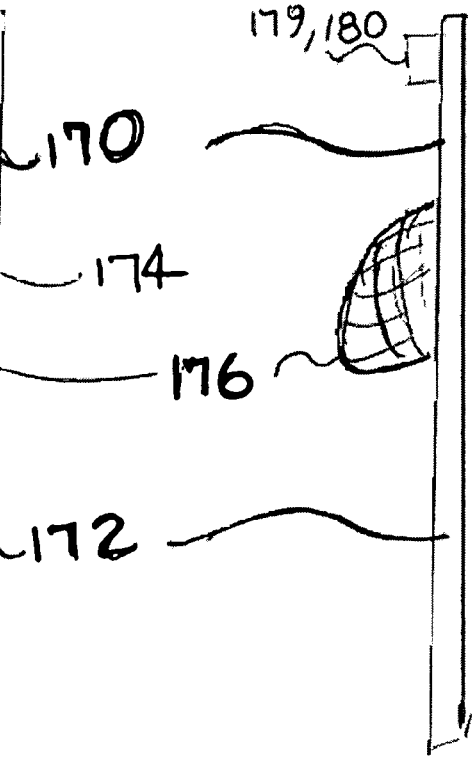
Figure 11A:
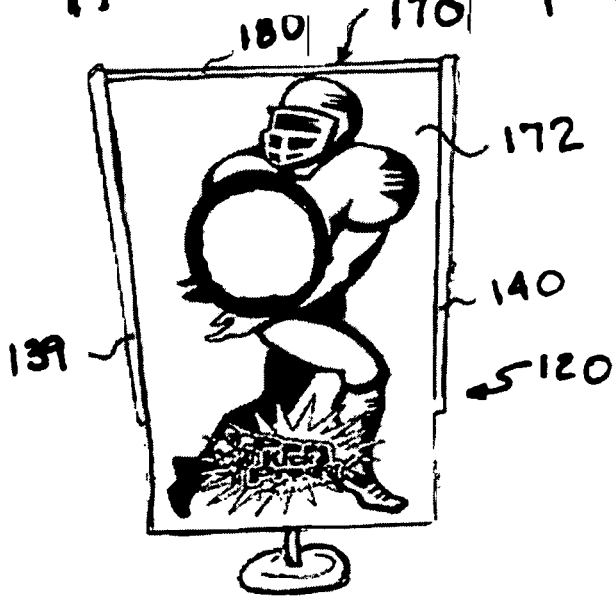

FIGS. 11 and 12 are a front and side elevation of a first embodiment of a pass receiving apparatus 170 used in conjunction with a forward passing activity. The apparatus 170 in the present embodiment comprises a sheet 172 with an aperture comprising a target 174. The sheet 170 could comprise a solid wall. However, it is preferable to use a textile sheet so that it may be folded to fit in the container 5. A net 176 may be fastened around the target 174 to receive balls 160 successfully propelled through the target aperture. Left and right cups 179 and 180 are fastened to the rear of the sheet 172. The left and right cups 179 and 180 are supported respectively to the left and right goal post uprights 139 and 140. In another form, illustrated in FIG. 11*a*, the sheet 172 may be flexible and supported to the goal post 120. In this embodiment, a support rod 182 is fastened in a top end of the sheet 172. Opposite ends of the support rod 182 are supported to the goal post uprights 139 and 140.

Figure 13:
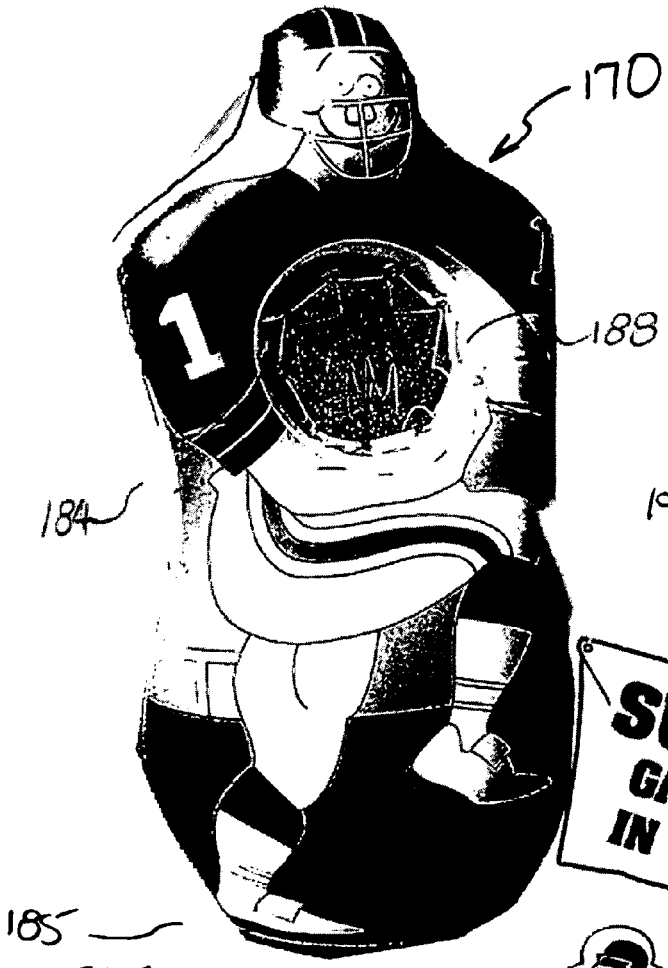
FIG. 13 is an illustration of a second embodiment of pass-receiving apparatus.

FIG. 13 is an illustration of a second embodiment of the pass receiving apparatus 170. In this embodiment, the pass receiving apparatus comprises an inflatable FIG. 184 which may bear indicial depicting a football player. The inflatable FIG. 184 has a weighted lower bottom 185. A central aperture is formed in the inflatable FIG. 184 to provide a target 188. The target 188 is placed on a chest area of the FIG. 184 to simulate an area on the body of a receiver to which it is generally desirable to place a pass. A net 190 is fastened around the boundary of the target 188 to catch the ball 160. In game play, a player throws the ball toward the target 174 of FIG. 12 or target 188 of FIG. 13. The objective is to get the ball 160 into a target.

Figure 14:
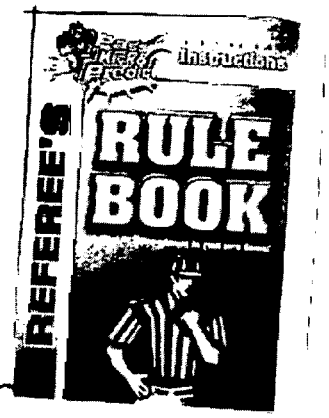
FIG. 14 illustrates a rule book.

FIG. 14 illustrates a rule book 195 which is included in the game set. The rule book 195 contains instructions for the game. Rules include criteria for earning awards, the manner in which predictions must be recorded and specification of physical tasks to be performed. Procedures to be followed by officials may also be listed.

Figure 15:
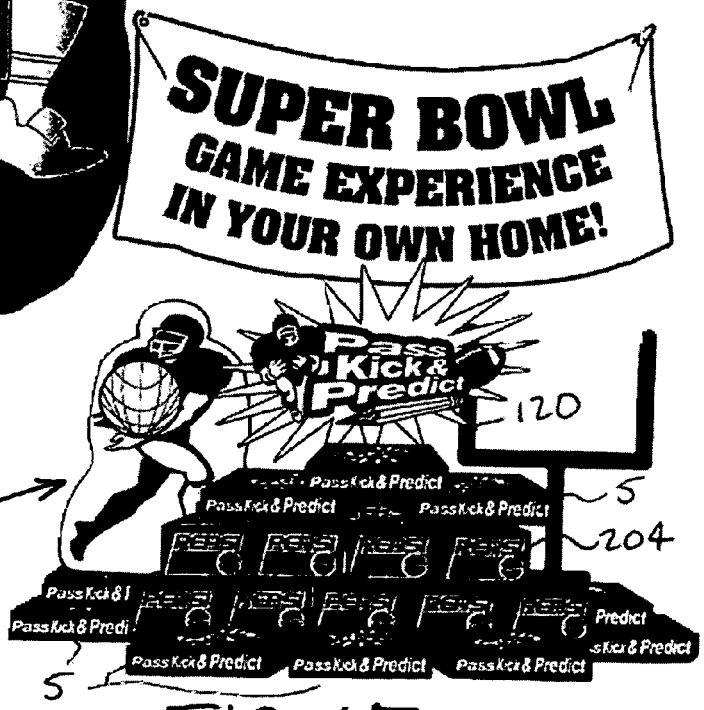
FIG. 15 is an illustration of a plurality of game system containers included in a promotional display.

FIG. 15 is an illustration of a plurality of game system containers included in a promotional display 200. The promotional display 200 includes a combination of containers 5, retail product units 204 and elements of the game system 1. The display 200 of the present embodiment comprises a goal post 120. Further game elements may be included in the display 200.*h* a player's total score accumulated on the game card 20 is totaled.

Embodiments of the invention can be varied in many ways. Such variations are not to be regarded as a departure from the spirit and scope of the invention, and all such modifications are intended to be within the scope of the invention.

What is claimed is:

1. A game system to be played in conjunction with an event as the event is taking place comprising:

a first subsystem and a second subsystem, said first subsystem comprising a set of prediction cards, each said prediction card comprising a plurality of prediction fields, each said field comprising indicia relating to an element of the event with respect to which a prediction may be made and a blank area adjacent each said prediction field to receive entered information with respect to the element of the event; each said prediction card including at least a field specifying a point value associated with a correct predictions, said prediction cards each being divided into sections wherein each section corresponds to a resolvable portion of the event;

said first subsystem further comprising a tote board having a plurality of locations, each location including at least a field corresponding to at least one field on said prediction cards, said tote board comprising at least one further location, each said at least one further location comprising a field to record a score associated with performance of players, and a field for displaying a sum of scores for players, said tote board further comprising fields to register a notation with respect to physical performance of a player with respect to a criterion, said tote board comprising means for comparing scores of participants; and a second subsystem comprising an object manipulatable by a player to perform a physical activity based on an element of the event, said object manipulatable by a player comprising a target having a defined area at which placement of the object will comprise a point-scoring activity;

wherein the event is a football game and wherein said prediction cards are divided into sections corresponding to quarters, wherein the object comprises a football and wherein said target comprises a goal post assembly.

* * * * *